United States Patent [19]

Wechner

[11] Patent Number: 4,655,507

[45] Date of Patent: Apr. 7, 1987

[54] CONTINUOUS MINER

[75] Inventor: Edward Wechner, Minnamurra, Australia

[73] Assignee: Joy Manufacturing Company, Pittsburgh, Pa.

[21] Appl. No.: 612,215

[22] Filed: May 21, 1984

[51] Int. Cl.[4] ..... E21C 29/22

[52] U.S. Cl. ..... 299/33; 299/71; 299/75

[58] Field of Search ..... 299/31, 33, 43, 54, 299/71, 75, 87

[56] References Cited

U.S. PATENT DOCUMENTS

| | | | |
|---|---|---|---|
| 3,718,369 | 2/1973 | Anderson | 299/87 X |
| 4,027,918 | 6/1977 | Hujimori et al. | 299/71 X |
| 4,131,317 | 12/1978 | Jamison et al. | 299/31 |
| 4,199,193 | 4/1980 | Damron et al. | 299/31 |
| 4,394,053 | 7/1983 | Schupphaus | 299/87 X |
| 4,465,155 | 8/1984 | Collins | 299/1 X |
| 4,465,319 | 8/1984 | Brownlie | 299/54 X |

FOREIGN PATENT DOCUMENTS

| | | |
|---|---|---|
| 1116454 | 11/1965 | United Kingdom . |
| 1310228 | 10/1969 | United Kingdom . |
| 2031048 | 7/1982 | United Kingdom . |
| 2123879 | 7/1982 | United Kingdom . |
| 2125857 | 7/1983 | United Kingdom . |

*Primary Examiner*—Stephen J. Novosad
*Assistant Examiner*—Thomas J. Odar
*Attorney, Agent, or Firm*—Raymond W. Augustin

[57] ABSTRACT

A maneuverable mining machine is disclosed. The mining machine has a chassis with at least one cutting head mounted on the front of the chassis and adapted to cut into a mine face extending transversely across the front of the machine. The cutting head comprises a cutting drum which is rotatable in a plane parallel to the mine face. The cutting head is mounted on the chassis by way of a support member arranged to effect movement of the cutting drum parallel to the face. A conveying means is mounted on a chassis and is arranged to convey mine material from the front of the chassis to the rear of the chassis.

12 Claims, 9 Drawing Figures

CONTINUOUS MINER

BACKGROUND OF THE INVENTION

This invention relates to mining machines, primarily though not exclusively intended for coal mines, and relates particularly to machines known as continuous miners.

Known methods of mining coal include board and pillar mining, and longwall mining. In longwall mining, entries or roads are driven about 200 meters apart. A coal face is formed between the roads either at the starting points of the roads in the longwall advancing method or at the end of the roads in the longwall retreating method. In the longwall advancing method, the face is mined traversing the face and shearing off a certain depth from the face. Under repeated traversals, the face advances in the direction of the roads. In the longwall retreating method, the method of mining is the same except that mining starts from the ends of the roads and the face retreats in the reverse direction of the roads.

A common type of machine employed for longwall mining is known as the Anderson shearer and comprises two cutter drums rotating parallel to the face at each end of a carriage. Both drums act to cut into the face and shear off coal as the machine is moved across the entire length of the face.

In board and pillar mining, a board or area of coal is mined and pillars of coal are left at intervals to support the roof. A machine known as the continuous miner has been developed for cutting out the coal in board and pillar mining. The term "continuous miner" arises because the machine can cut continuously without requiring shot firing of the coal face, in contrast to earlier types of machines. A continuous miner is a versatile type of machine and can also be used for cutting roads and is useful in cutting breakaway routes and air vents from existing roads.

A common form of continuous miner is shown schematically in FIGS. 1 and 2. It comprises a chassis 2 with a personnel cabin 4 mounted for free movement by means of crawler tracks 6. At the front end is mounted a cutting head 8 mounted with its axis parallel to the coal face on pivot arm 10. Arm 10 is raised and lowered by hydraulic rams 12. A loading apron 14 is provided at ground level beneath cutting head 8, apron 14 including a conveyor 16 which extends along the body 2 to communicate with a loading jib 18 for disposing of cut coal. In operation the cutting head is pivoted up and down to cut the face and the cut coal is gathered up by the conveyor. In order to cut across a face which is wider than the machine, the machine is slewed across the face by means of the crawler tracks.

In order to break away from an existing road way or to form an air vent, the miner is angled towards the side of the road (the road is only 5.5 m wide, and the miner cannot be manoeuvred sideways on), and the cutting head cut into the side of the road in a series of advance and reversing motions of the miner.

A problem with all types of mining is to reinforce the roof of the mine subsequent to cutting the coal. Various types of machine are available for providing reinforcement, but a very common method of reinforcing is to insert roof bolts into drilled holes in the roof. The roof bolts are secured in the drilled holes and a nut on the projecting end of the bolt tightened. This acts to reinforce the surrounding rock.

Roof bolts are commonly used when operating a continuous miner and frequently the miner itself may be equipped to drill holes in the roof. As shown in FIGS. 1 and 2, the miner has roof drills 20 one on either side of pivot arm 10. In order to operate these drills, the cutting head 8 is stopped in operation and the drilling operation is carried out.

A disadvantage with this arrangement is the relatively large distance between the cutting head and the roof drills which may be as great as 4 m. Thus in areas where the roof is loose, there may be an unstable region relatively large in extent.

SUMMARY OF THE INVENTION

It is therefore an object of the present invention to provide a mining machine which will obviate or minimise the foregoing disadvantages in a simple yet effective manner or which will at least provide the public with a useful choice.

Accordingly the invention consists in a mining machine comprising a maneuverable chassis, at least one cutting head mounted on the front of the chassis adapted to cut into a face extending transversely across the front of the machine, the cutting head comprising a cutting drum rotatable in a plane parallel to the face, mounted on the chassis by way of a support member arranged to effect movement of the cutting drum parallel to the face, and conveying means mounted on the chassis arranged to convey mined material from the front of the chassis toward the rear of the chassis.

Because the movement of the various parts of the cutting head occur in a plane parallel to the face which is intended to be cut, it is possible to achieve a compact dimension of the cutting head in the length dimension of the body. Thus roof drills of the machine may be mounted behind the cutting head and disposed close to the face, and holes may be drilled and roof bolts inserted close to the face. This ensures that support is provided where it is needed without the danger of loose roof being left unsupported. A further advantage arises in that since the movement of the cutting head occurs in a plane parallel to the face, it is not necessary to move the body during a cutting operation of the face. Thus if required the roof drill or drills may be operated while the machine is cutting the face. Any number of roof drills may be provided (five being a convenient number) preferably in a row directly behind the cutting head.

A further advantage of the invention arises in increased maneuverability while cutting. This is particularly useful when the machine is employed to cut at an angle to an existing face, for example to break away from an existing road. The machine may be maneuvered at an angle to the face before the cutting operation commences. When the cutting operation commences, the sideways movement of the cutting drum relative to the body ensures that a corner of a pillar or a junction with a road can be cut readily; this is in contrast to the known type of continuous miner described above where it is impossible to cut sideways to the body of the machine and hence it is not as easy to maneuver the machine to cut around corners.

As preferred each cutting drum is mounted on a ranging arm pivotable in a plane parallel to the face, each ranging arm being mounted on the chassis by way of a support member arranged to effect transverse movement of the cutting drum parallel to the face. This provides the cutting drums with a wide range of movement.

The arrangement of ranging arms and support members ensures that the cutting head can traverse the entire area in front of the chassis to cut at least across the width and height of the machine. However as preferred, the ranging arms and range of movement of the support member will be such that the ranging arms can project a substantial distance beyond the width and height of the mining machine. This ensures that a relatively large area may be cut by the machine without movement of the machine chassis. When the cutting head is inoperative the ranging arms may be retracted so that they do not project beyond the sides of the chassis for ease of maneuvering of the machine to another location. Thus the present invention provides a very compact arrangement of cutting head for manoeuvring of the machine.

As preferred two cutting drums with respective ranging arms are provided, each ranging arm being mounted on the support member. This provides a large range of movement and flexibility in operation and speeds the cutting process.

By providing two cutting drums, these can be operated simultaneously. As the support member slides across the face, the ranging arms may be pivoted in a predetermined manner so that the cutting heads cut the entire face region in front of the machine in a single operation, each cutting drum following an optimum route so that at no point in time is a cutting drum moving over areas of the face which have already been cut and at all times both cutting drums are operative in cutting the face. As preferred, the machine is numerically controlled so that the drums and ranging arms automatically follow a preprogrammed route as the support member slides across the front of the chassis in order to cut the face in a single operation.

As preferred each ranging arm includes gear elements for transmitting power to the cutting drums. The support member preferably contains the motors for moving the cutting drums and ranging arms and also gear elements. The support member is preferably mounted for sliding movement by means of a rack and pinion gear. Since it is necessary precisely to control the movement of the parts of the cutting head, the motors are electric motors which can be precisely controlled.

Since the cutting drums cut in shear as they move across the face, the design of the cutting drums are such as to permit a shearing cutting action. However in accorance with a preferred feature of the invention, the cutting drums are also arranged to "sump" by which is meant the cutting drums can cut directly into the face in a direction normal to the face. This is desirable as a first cutting movement when the mining machine approaches the face, since after the cutting drums have been sumped into the face by forward movement of the machine, then the cutting drums may move in a direction parallel to the face to cut the face with a shearing action. To ensure a sumping action, the cutting drums are designed with a head which has one or more, preferably two, radial lines of cutting picks extending from the centre of the cutting drum in a front circular face of the drum. The face is preferably flat so that drilling forces are not created during shearing movements; this would affect the mining machine adversely. The radial lines of cutting picks may be straight or alternatively curved. Since the major force exists on the outermost pick, a further row of picks may preferably be provided in the flat front face of the drum, extending in a circular arc behind the outermost pick to provide a support of the outermost pick. The lines of cutting picks act in the manner of a mill to sump the drum. As regards spacing of the cutting picks, this is a balance between effectiveness in cutting where the fewer the picks, the more effective the cutting, and the wear on the picks, where the more picks, the less wear on the picks. It has been found a spacing of 6 to 7.5 cm is the optimum.

The shearing action of the cutting drums is preferably provided by one or more spiral arcs on the circumference of the drum having cutting picks along their periphery. It is preferred to provide arcs as opposed to continuous spirals, since this permits the coal to be ejected from the rear of the drum more rapidly. If desired a large number of cutting picks could be provided over the cylindrical surface of the cutting drum if desired in spiral arcs having a deep spiral. The greater the number of picks, the more dust is created and small pieces of coal. For the present inventon it is preferred to reduce the number of picks and increase the cutting effectiveness of the drum.

DESCRIPTION OF THE DRAWINGS

In one broad form the present invention will now be described by way of example only with reference to the accompanying drawings, wherein.

DESCRIPTION OF THE PREFERRED EMBODIMENT

Figure 1:
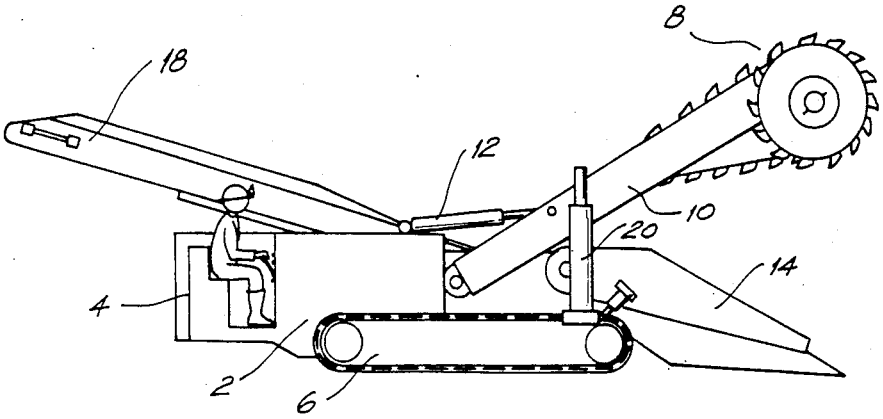
FIG. 1 is a schematic side view of a known continuous miner.
Figure 2:
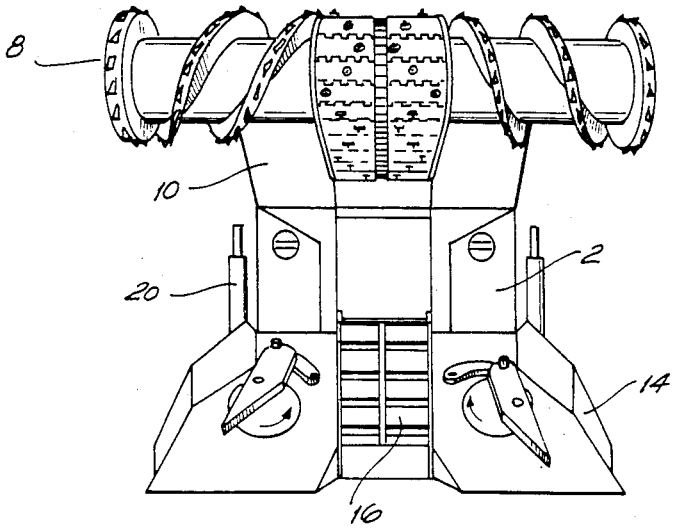
FIG. 2 is a front view of the known continuous miner.
Figure 3:
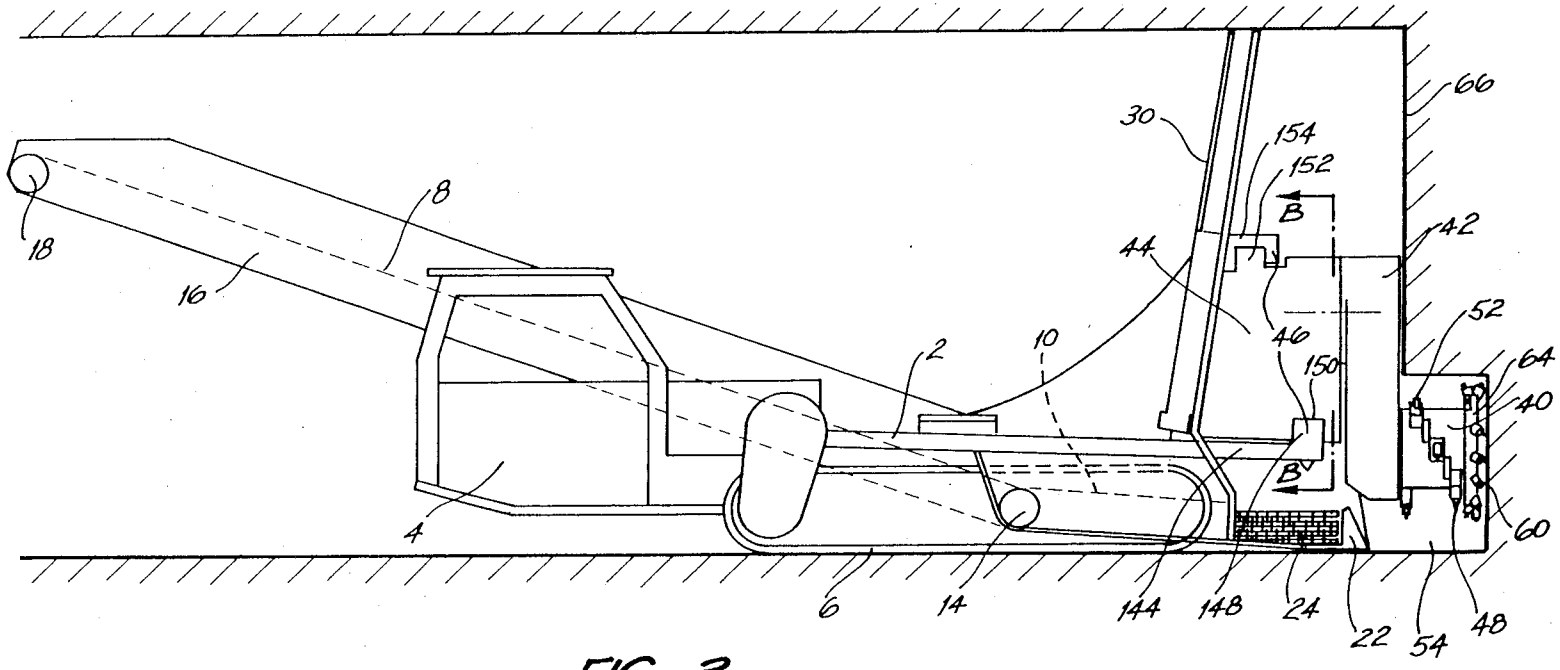
FIG. 3 is a side view of the continuous miner according to the invention.

Referring now to the continuous miner according to the invention shown in FIGS. 3–8, there is shown a chassis 2 and personnel cabin 4 mounted on crawler tracks 6. Typically the chassis 2 is 8.2 m long by 3.6 m wide, by 1.8 m high. A conveyor 8 extends from the front to the rear of the chassis. This conveyor section is tiltable around pivot 14 in an upwards direction to enable coal to be conveyed into a waiting truck or shuttle car (not shown). The conveyor is driven by a chain drive 20. The front of the conveyor is disposed in a loading apron 22 which is arranged for collecting coal as it is cut from the face. The loading apron includes lateral side conveyors 24 which convey the coal towards the conveyor 8.

Toward the front of the chassis is mounted a row of five roof drills 30 mounted directly behind the cutting head of the machine and disposed about one meter from the front of the cutting head. As shown, the roof drills are inclined at 5 degrees to the vertical in order to minimize the distance between the roof bolts and the face.

However if desired the roof drills may be mounted vertically; this may give a more secure mounting for a roof bolt at the expense of the roof bolt being disposed a slightly greater distance away from the front of the cutting head, about 1.2 m. The roof drills are conventional in design and will not be described further.

The cutting head comprises two rotating cutting drums 40 mounted on pivotable ranging arms 42 which are in turn mounted for pivotal movement on a support member 44 comprising a gear case which is mounted for slidable movement on linear bearing members 46 extending across the front of the chassis of the mining machine.

In more detail, each cutting drum is generally cylindrical and comprises two semicircular members 48 formed as spiral arcs to extend from the front of the cutting drum towards the rear of the cutting drum. This clearly can be seen in FIG. 8. The spiral arc members are disposed in opposing halves of a circle and a gap 50 between the two arcs permits cut coal to be ejected behind the cutting drum. Each member 48 has replaceable cutting picks 52 disposed along its spiral edge disposed between 6 cm and 7.5 cm apart. This spiral members 48 provide a cutting action in shear; that is, as the cutting drums move along across the face in a direction parallel to the face the spiral members 48 act to shear coal from the face.

The cutting drum additionally includes two members 58 positioned in the flat front face of the drum and shaped as 90 degree arcs of circle diametrically opposing one another. Removable cutting picks 60 are provided between 6 cm and 7.5 cm apart along one radius 62 of each segment member and along the circumference 64 of each segment member. The radius line 62, which is in use the leading edge of the segment, is coterminous with the leading edge of the semicircular spiral arc member 48. The circular segments are provided in order to permit a sumping action of the cutting drums, nearly to permit the cutting drums to cut in a direction normal to the face by forward movement of the machine so that the cutting drums can be disposed wholly within the face prior to traversing the face. This is shown schematically in FIG. 3 where sumps 54 are cut in a face 66.

Figure 6:
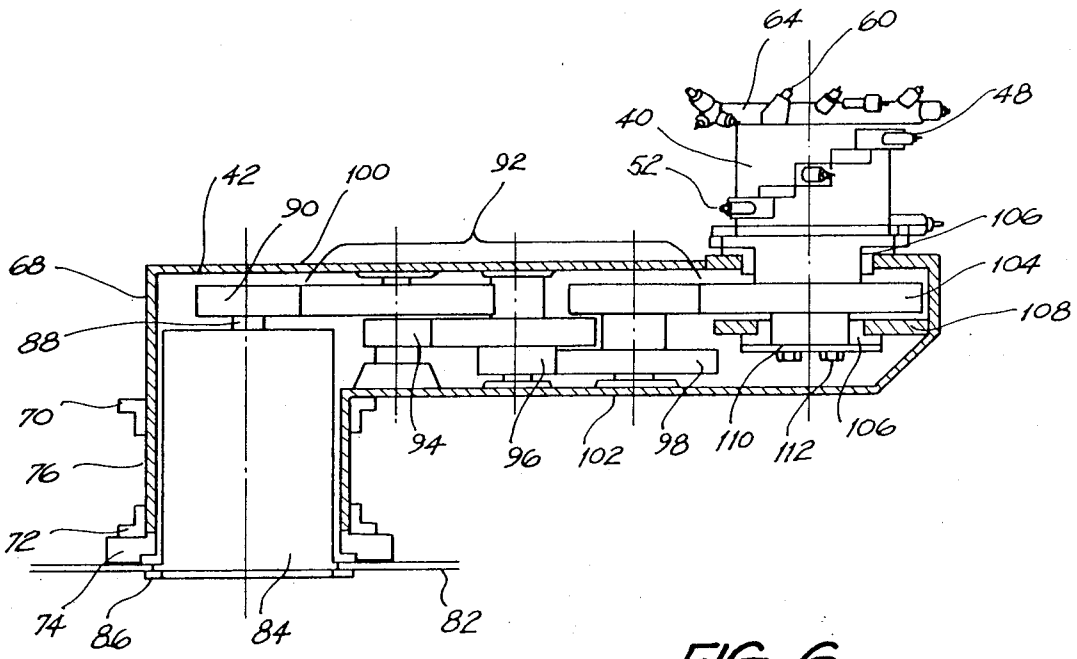
FIG. 6 is a sectional view along the lines A—A of FIG. 5.
Figure 7:
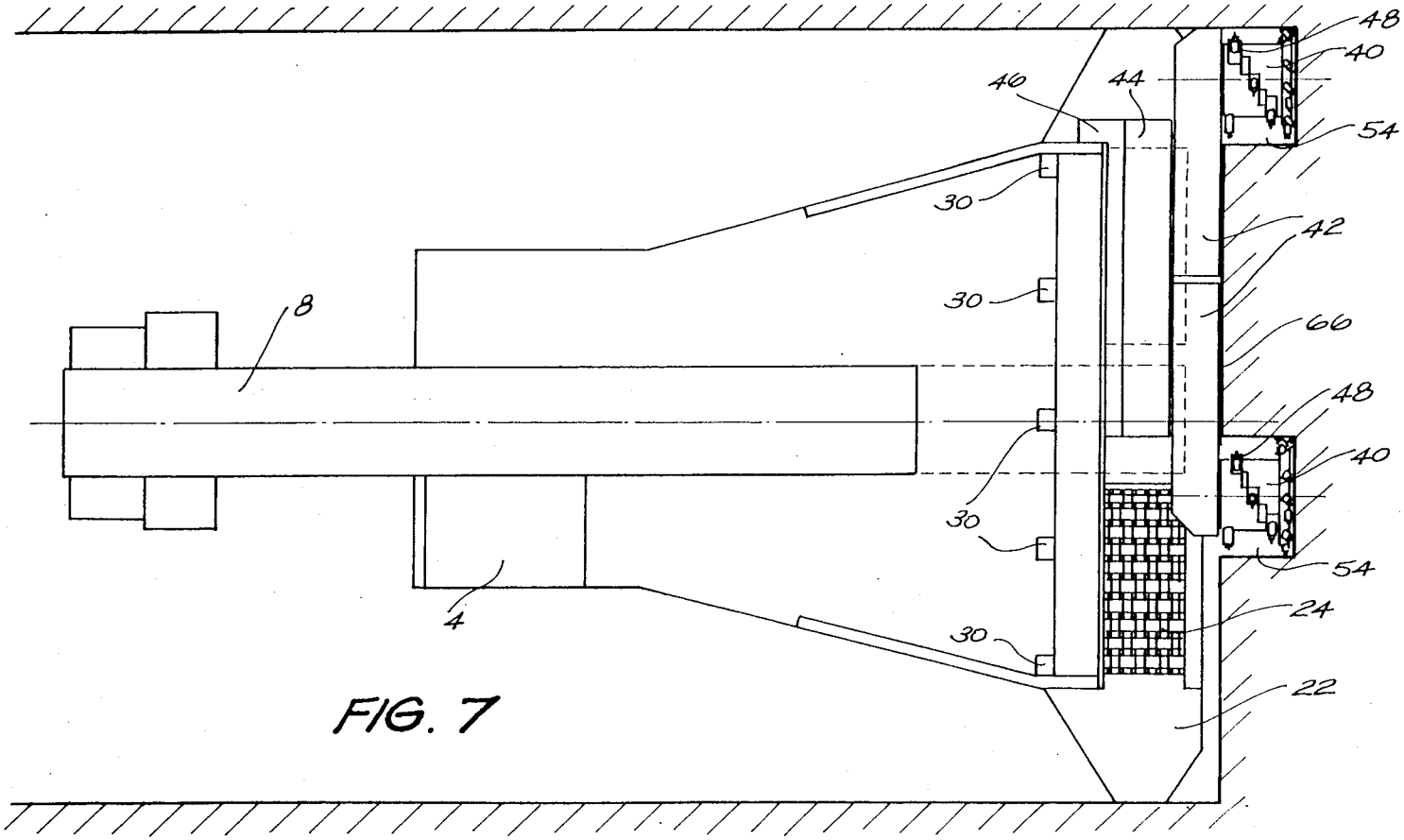
FIG. 7 is a top plan view of the continuous miner of FIG. 3.
Figure 8:
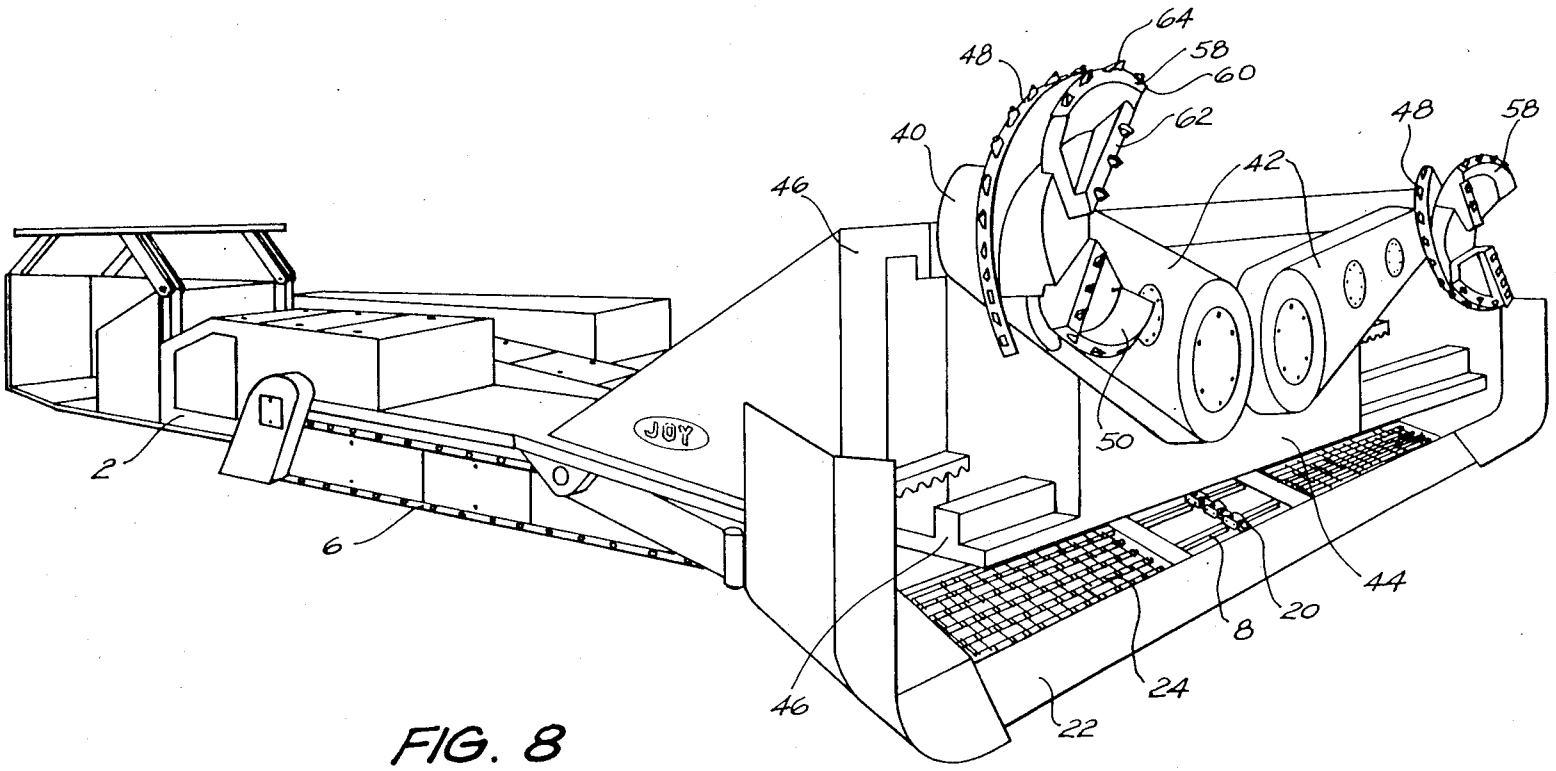
FIG. 8 is a perspective view of the continuous miner according to the invention.

Each cutting drum 40 is mounted on a ranging arm 42 which is shown in detail in FIG. 6. Each ranging arm has a pivot base portion 68 which extends at right angles to the major part of the arm and is disposed within sliding gear case 44. As shown in FIG. 6 the angled sections 70,72 represent journals for the arm within the housing. Angled sections 70 are secured to the front face (not shown) of the sliding gear case, whereas sections 72 are mounted within the gear case. A gear member 74 is rigidly connected to the housing 76 of pivot base portion for transmitting movement to the ranging arm as will be described later. Gear member 74 is mounted between angled sections 72 and the rear face 82 of the sliding gear case. An electric motor 84 (e.g. a 100 HP induction motor) is mounted wholly within pivot base portion 68, and is fixed at its rear end 86 to the rear face 82 of the casing 44.

The drive shaft 88 of motor 84 is coupled to a gear element 90 of a spur gear train 92. The gear train 90 comprises gear elements 94, 96, 98, each journalled between the side walls 100, 102 of the ranging arm. Gear element 98 is coupled to a gear element 104 which is rigidly connected to drum 40. Drum 49 is mounted at the end of ranging arm 42 in angled sections 106 comprising journals in side wall 100 of arm 42. Angled sections 106 journal the inner end of the drum. Sections 106 are mounted in a wall 108 which projects internally of arc 42. A plate 110 is secured by bolts 112 to secure the drum in its journals.

Figure 4:
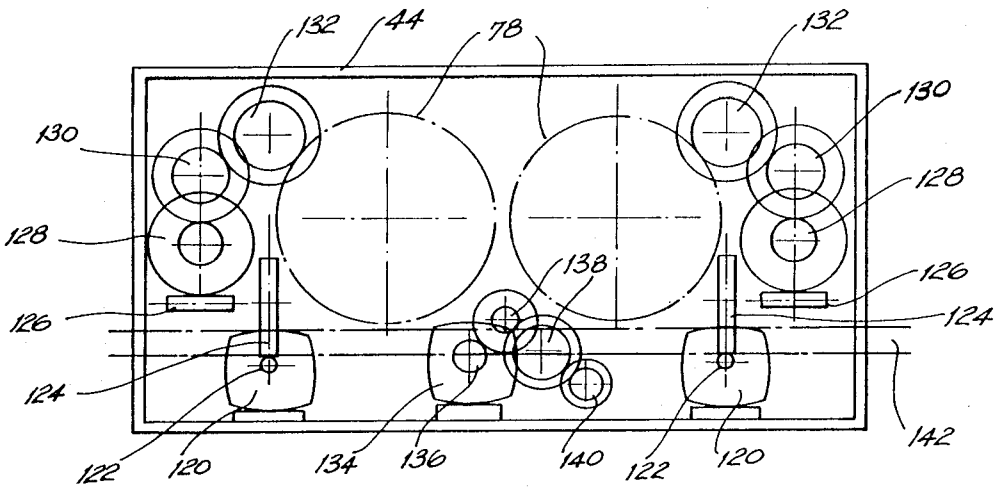
FIG. 4 is a sectional view along the lines B—B of FIG. 3.
Figure 5:
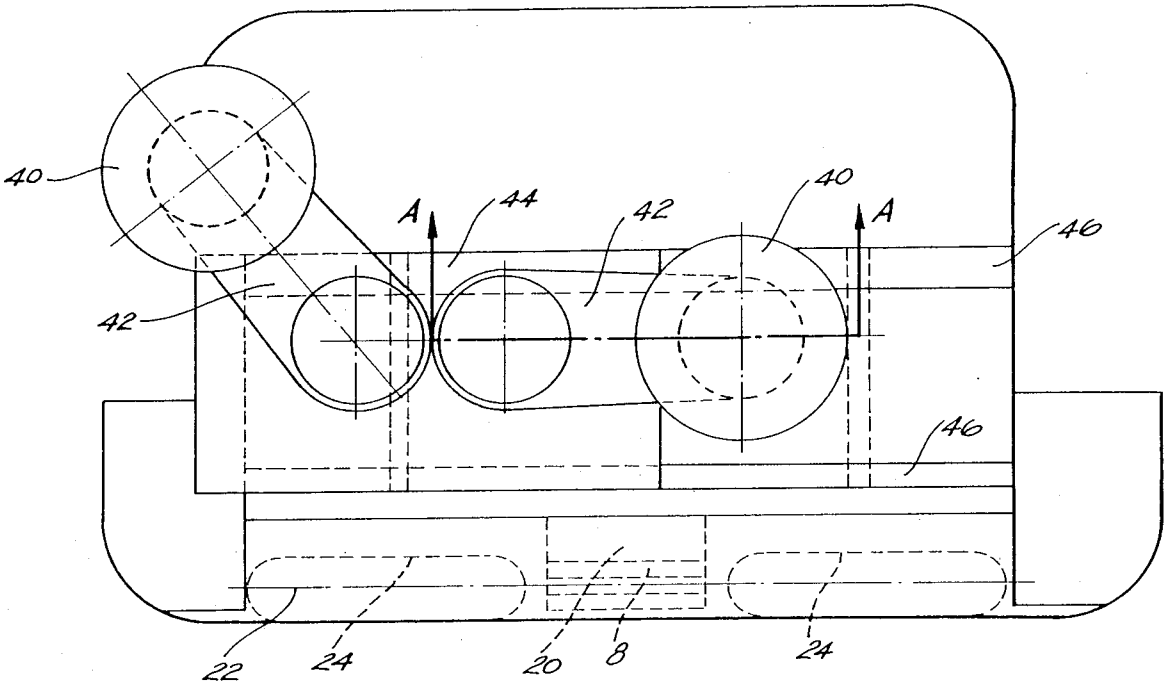
FIG. 5 is a front view of the continuous miner according to the invention.

Referring now to FIG. 4 there can be seen the interior of siding gear case support member 44. The gear case includes the two pivot base portions 68 of arms 42 together with electric motors 84 and gear members 78 (only gear members 78 are indicated for clarity). Two electric motors 120 (e.g. induction motors of 15 HP capacity) are each provided to rotate arms 42. Each motor 120 has an output shaft 122 in the form of a worm drive coupled to a worm wheel 124 which is in turn coupled to a worm 126 which drives a series or spur gear elements 128, 130, 132. Gear element 132 is coupled to gear member 78 for driving the entire ranging arm 42. The mountings of the motors 120 and the gear elements 124–132 are not shown but it will be understood and conventional mounting of the gear elements within gear case 44 may be employed.

A further electric motor 134 (e.g. an induction motor of 15 HP capacity) is disposed within the sliding gear casing and its output shaft 136 is coupled via gear elements 138 to a pinion member 140 for a rack and pinion gear, the rack being shown as 142. All the gear elements 138–140 are conventionally mounted within gear casing 44. The rack 142 may be seen in FIG. 8 as mounted at the rear of the sliding gear case and extending from one end to the other of the width of the machine. The sliding gear case 44 is mounted on a lower horizontal support 144 comprising a table member and a bar member 148 which engages within a slot 150 in the base of the sliding gear case. The top of the gear case has a part 152 configured to engage within a recess provided by a projecting member 154. As can be seen from FIG. 8 this permits movement of the sliding gear case from one end to the other of the width of the mining machine.

Figure 9:
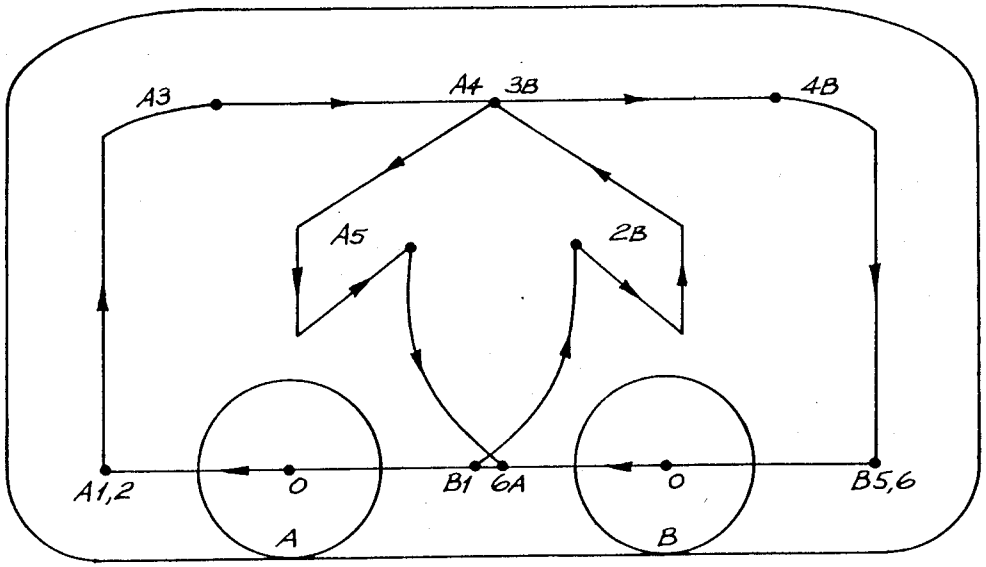
FIG. 9 is a schematic diagram of the path taken by the cutting drums in order to cut the face in front of the mining machine according to the invention.

The electric motors mounted within gear case 60 are all numerically controlled by a conventional control means known as a Programmable Logic Controller or PLC. The control may be preprogrammed to give a predetermined movement of the ranging arms 42 and sliding gear case 44. A plurality of movement routine may be provided if desired. In a typical cutting action of the machine, the movement indicated in FIG. 9 are carried out. In FIG. 9 the two cutter drums are indicated by the circles A and B. The two cutter drums start with their centres at position 0 and in this position the two drums are sumped into the coal face. After the sumping operation has been carried out the two drums move to the positions A1 and B1. It will be appreciated this movement merely involves motion of the gear case 44. Drum A remains in position A1 while the ranging arm 42 for drum B1 is pivoted upwardly to position B2. Thereafter drum A moves upwardly and then generally horizontally but arching upwards to position A3 while drum B undergoes a complex manoeuvre involving a diagonal movement downwards, a vertical movement upwards and then a diagonal movement in the opposite direction to position B3. These movements involve motion of the ranging arms 42 and the sliding gear case 44. The sliding gear case 44 is then moved so that the drum move from positions A3, B3 to positions A4, B4. In position A4, there is a combination of movement of the sliding gear case and ranging arms so that drum A undergoes a complex manoeuvre from position A4 to position A5 involving a diagonal movement downwards followed by a vertical movement downwards and then a diagonal movement upwards to position A5. During this motion drum B undergoes a generally horizontal movement but arching downwards followed by a vertically downward movement to position B5. Drum B remains in this position while ranging arm 42 of drum A pivots downwardly to position A6. The movement is thus completed and it can be seen that with this motion the whole of the face is traversed by the cutting drums so that no part of the face remains uncut.

It has been found that the above motion provides the optimum route for cutting a coal face in front of the miner although of course other types of motion could be devised. For examples a more pronounced arch to the roof may be cut. In addition for other types of cutting motion, for example cleaning a road after a days work in which the sides of the road may have been damaged a different preprogrammed series of movement of the cutting drums may be provided.

I claim:

1. A mobile mining machine comprising a crawler chain propelled maneuverable chassis, at least one cutting head mounted on the front of the chassis and capable of both being driven by said machine into a mine face and the cutting along said face transversely across the front of the machine, cutting head including a pair of auger-type cutting drums rotatable about an axis perpendicular to the face, said cutting drums mounted on the cutting head by way of a pair of independent support members for each cutting drum said support members arranged to effect, both horizontal and vertical movement of each cutting drum parallel to the face independently of one another, means for preprogramming the movement of each of said support members to effect cutting of the entire face as said cutter head traverses said face; and conveying means mounted on the chassis arranged to convey mined material from the front of the chassis toward the rear of the chassis.

2. A mining machine as claimed in claim 1, wherein the support member comprises a ranging arm rotatably mounted to the chassis about an axis perpendicular to the face at one end, and supporting the cutting drum protruding forwardly therefrom at the other end.

3. A mining machine as claimed in claim 2, wherein the ranging arm is mounted to the chassis by way of a sliding gear case arranged for transverse movement across the front of the chassis parallel to the face.

4. A mining machine as claimed in claim 2, wherein the or each ranging arm incorporates a gear train drivable by way of a shaft located on said axis perpendicular to the face, and in turn driving the cutting drum mounted thereon.

5. A mining machine as claimed in claim 1 wherein at least one roof bolt hold drills are provided extending upwardly from the chassis behind the cutting head.

6. A mining machine as claimed in claim 5, wherein a transverse row of roof bolt hole drills are provided, located as closely as possible behind the cutting heads.

7. A mining machine as claimed in claim 1 wherein the or each cutting drum comprises a substantially cylindrical drum having at least one spiral arc of cutting picks on the circumferential face thereof.

8. A mining machine as claimed in claim 7, wherein the cutting drum is provided with cutting picks on the leading radial face thereof, arranged to cut into the face upon forward movement of the machine.

9. A mining machine as claimed in claim 8, wherein two said spiral arcs of cutting picks are provided in the circumferential face and wherein the cutting picks on the leading radial face are arrayed in two radial rows, the outer end of each radial row being coterminous with the leading end of the respective spiral arc.

10. A mining machine as claimed in claim 9, wherein two circumferential rows of cutting picks are provided in the leading radial face, the leading ends of the circumferential rows being respectively coterminous with the leading ends of the two spiral arcs.

11. A method for cutting an entryway into a mine face in an underground mine utilizing a self-propelled, crawler chain-driven machine having a cutting head including a pair of auger-type cutters mounted at forward end thereof; said methd comprising the steps of:

sumping said cutting head into the mine face by propelling said machine into said face;

independently moving each of said cutters both horizontally and vertically in a preprogrammed pattern as said cutter head moves in a direction parallel to said face, to cut the entire extent of said entry way;

conveying the coal cut by said cutter head to the rear of said machine; and repeating said steps with the cutter head traversing said face across the front of the machine in a direction parallel to said face.

12. A mining machine as claimed in claim 1 wherein said preprogrammed movement of said support arm is accomplished by a numerical control system capable of controlling the movement of said support arm in any predetermined manner.

* * * * *